United States Patent [19]

Mohr

[11] Patent Number: 4,566,959

[45] Date of Patent: Jan. 28, 1986

[54] PROCESS FOR THE ELECTROCHEMICAL ROUGHENING OF ALUMINUM USEFUL FOR PRINTING PLATE SUPPORTS, IN AN AQUEOUS MIXED ELECTROLYTE

[75] Inventor: Dieter Mohr, Schlangenbad, Fed. Rep. of Germany

[73] Assignee: Hoechst Aktiengesellschaft, Frankfurt am Main, Fed. Rep. of Germany

[21] Appl. No.: 689,001

[22] Filed: Jan. 4, 1985

[30] Foreign Application Priority Data

Jan. 5, 1984 [DE] Fed. Rep. of Germany ..... 3400248

[51] Int. Cl.[4] ..... C25F 3/04

[52] U.S. Cl. ..... 204/129.75

[58] Field of Search ..... 204/129.75, 129.8, 129.4

[56] References Cited

U.S. PATENT DOCUMENTS

| | | | |
|---|---|---|---|
| 2,336,846 | 12/1943 | Clark | 204/129.75 |
| 2,775,553 | 12/1956 | Kahan | 204/129.8 |
| 3,330,745 | 7/1967 | Jestl et al. | 204/33 |
| 3,632,486 | 1/1972 | Herrmann | 204/33 |
| 3,755,116 | 8/1973 | Terai et al. | 204/129.95 |
| 3,766,043 | 10/1973 | Herrmann et al. | 204/207 |
| 3,963,594 | 6/1976 | Brasko | 204/129.95 |
| 4,072,589 | 2/1978 | Golda et al. | 204/129.4 |
| 4,502,925 | 3/1985 | Walls | 204/129.75 |

FOREIGN PATENT DOCUMENTS

| | | | |
|---|---|---|---|
| 120061 | 2/1900 | Fed. Rep. of Germany | 204/129.75 |
| 695182 | 7/1940 | Fed. Rep. of Germany | 204/129.75 |
| 1496825 | 4/1969 | Fed. Rep. of Germany | 204/129.75 |
| 17580 | 7/1978 | Japan | 204/129.75 |
| 294237 | 9/1929 | United Kingdom | 204/129.75 |
| 1166901 | 10/1969 | United Kingdom | 204/129.75 |
| 1400918 | 7/1975 | United Kingdom | 204/129.75 |
| 1427909 | 3/1976 | United Kingdom | 204/129.75 |

OTHER PUBLICATIONS

Dowell, A. J., Transactions of the Institute of Metal Finishing, vol. 57, p. 138, 1979.

*Primary Examiner*—T. M. Tufariello

*Attorney, Agent, or Firm*—Schwartz, Jeffery, Schwaab, Mack, Blumenthal & Evans

[57] ABSTRACT

In the electrochemical roughening of aluminum or its alloys useful for printing plate supports, an aqueous mixed electrolyte solution is employed, which contains hydrochloric acid (HCl) and, as a further ionic halogen compound, at least one inorganic fluorine compound which is present in the form of an acid or an alkali metal salt and the anion of which contains fluorine and at least one further element (for example, $SiF_6^{2-}$ or $PO_3F^{2-}$). In particular, the solution contains from about 0.5 to 10% by weight of HCl and from about 0.5 to 5% by weight of the fluorine compound. The very uniformly roughened support materials are used in the production of offset printing plates.

4 Claims, No Drawings

PROCESS FOR THE ELECTROCHEMICAL ROUGHENING OF ALUMINUM USEFUL FOR PRINTING PLATE SUPPORTS, IN AN AQUEOUS MIXED ELECTROLYTE

BACKGROUND OF THE INVENTION

The present invention relates to a process for the electrochemical roughening of aluminum which can be used for printing plate supports, said process being performed by means of alternating current in an aqueous mixed electrolyte.

Printing plates (this term referring to offset-printing plates, within the scope of the present invention) usually comprise a support and at least one radiation-sensitive (photosensitive) reproduction layer arranged thereon, the layer being applied to the support either by the user (in the case of plates which are not pre-coated) or by the industrial manufacturer (in the case of pre-coated plates). As a layer support material, aluminum or alloys thereof have gained general acceptance in the field of printing plates. In principle, it is possible to use these supports without modifying pretreatment, but they are generally modified in or on their surfaces, for example, by a mechanical, chemical and/or electrochemical roughening process (sometimes also called graining or etching in literature), a chemical or electrochemical oxidation process and/or a treatment with hydrophilizing agents. In modern continuously working high-speed equipment employed by the manufacturers of printing plate supports and/or pre-coated printing plates, a combination of the afore-mentioned modifying methods is frequently used, particularly a combination of electrochemical roughening and anodic oxidation, optionally followed by a hydrophilizing step. Roughening is, for example, carried out in aqueous acids, such as aqueous solutions of HCl or $HNO_3$ or in aqueous salt solutions, such as aqueous solutions of NaCl or $Al(NO_3)_3$, using alternating current. The peak-to-valley heights (specified, for example, as mean peak-to-valley heights $R_z$) of the roughened surface, which can thus be obtained, are in the range from about 1 to 15 μm, particularly in the range from 2 to 8 μm. The peak-to-valley height is determined according to DIN 4768, in the October 1970 version; the peak-to-valley height $R_z$ is the arithmetic mean calculated from the individual peak-to-valley height values of five mutually adjacent individual measurement lengths.

Roughening is, inter alia, carried out in order to improve the adhesion of the reproduction layer to the support and to improve the water acceptance of the printing form which results from the printing plate upon irradiation (exposure) and developing. By irradiating and developing (or decoating, in the case of electrophotographically-working reproduction layers), the ink-receptive image areas and the water-retaining non-image areas (generally the bared support surface) in the subsequent printing operation, are produced on the printing plate, and thus the actual printing form is obtained. The final topography of the aluminum surface to be roughened is influenced by various parameters, as is explained by way of example in the text which follows:

The paper "The Alternating Current Etching of Aluminum Lithographic Sheet", by A. J. Dowell, published in Transactions of the Institute of Metal Finishing, 1979, Vol. 57, pages 138 to 144, presents basic comments on the roughening of aluminum in aqueous solutions of hydrochloric acid, based on variations of the following process parameters and an investigation of the corresponding effects: The electrolyte composition is changed during repeated use of the electrolyte, for example, in view of the $H^+(H_3O^+)$ ion concentration (measurable by means of the pH) and in view of the $Al^{3+}$ ion concentration, with influences on the surface topography being observed. Temperature variations between 16° C. and 90° C. do not show an influence causing changes until temperatures are about 50° C. or higher, the influence becoming apparent, for example, as a significant decrease in layer formation on the surface. Variations in roughening time between 2 and 25 minutes lead to an increasing metal dissolution with increasing duration of action. Variations in current density between 2 and 8 $A/dm^2$ result in higher roughness values with rising current density. If the acid concentration is varied in a range from 0.17 to 3.3% of HCl, only negligible changes in pit structure occur between 0.5 and 2% of HCl, whereas below 0.5% of HCl, the surface is only locally attacked and at the high values, an irregular dissolution of Al takes place. An addition of $SO_4^{2-}$ ions or $Cl^-$ ions in the form of salts (e.g. by adding $Al_2(SO_4)_3$ or NaCl) can also influence the topography of the roughened aluminum. Rectification of the alternating current shows that, obviously, both half-wave types are necessary to obtain a uniform roughening.

Thus, it can be assumed that the use of aqueous HCl solutions as electrolyte solutions for the electrochemical roughening of support materials made of aluminum is known in principle. With these solutions it is possible (as is also evidenced by a great number of commerically available printing plates) to achieve a uniform graining, which is particularly suitable for applications in the field of lithography, and the roughness values of which vary within a range which in general is appropriate for practical use. For certain applications (for example, in the case of certain negative-working reproduction layers) there is, however, required a uniform and relatively "flat" roughened surface topography, which is difficult to obtain in the known electrolyte solutions based on HCl, using modern, high-speed apparatus. For example, the process parameters must be kept within very narrow limits, and this involves a process which can only be controlled with great difficulty.

The influence of the electrolyte composition on the quality of roughening is, for example, also described in the following publications, in which aqueous mixed electrolytes are employed:

- German Offenlegungsschrift No. 22 50 275 (British Patent Specification No. 1,400,918) specifies aqueous solutions containing from 1.0 to 1.5% by weight of $HNO_3$ or from 0.4 to 0.6% by weight of HCl and optionally from 0.4 to 0.6% by weight of $H_3PO_4$, for use as electrolytes in the roughening of aluminum for printing plate supports, by means of alternating current,
- German Offenlegungsschrift No. 28 10 308 (U.S. Pat. No. 4,072,589) mentions aqueous solutions containing from 0.2 to 1.0% by weight of HCl and from 0.8 to 6.0% by weight of $HNO_3$ as electrolytes in the roughening of aluminum with alternating current,
- German Auslegeschrift No. 12 38 049 (U.S. Pat. No. 3,330,743) mentions, as additional components in aqueous $HNO_3$ solutions used in the roughening of aluminum for printing plate supports with alternating current, protective colloids acting as inhibitors, for example, lignin, benzaldehyde, acetophenone or pine needle oil, U.S. Pat. No. 3,963,594 specifies aqueous solutions containing HCl and gluconic acid as electrolytes in the electrochemical roughening of aluminum for printing plate supports, and German Auslegeschrift No. 22 18 471 (U.S. Pat. No. 3,755,116) mentions the addition of anticorrosive agents, which include monoamines, diamines, carboxylic acide amides, urea, chromic acid and nonionic surfactants, to an aqueous HCl electrolyte, for roughening aluminum suitable for printing plate supports.

The known organic additives to aqueous acid electrolytes, such as HCl or $HNO_3$ solutions, have the disadvantage that, in the case of high current loads (voltages), they become electrochemically unstable in the modern continuously working web processing apparatus and decompose at least partially. The known inorganic additives, such as phosphoric acid, chromic or boric acid, exhibit the disadvantage that quite often there is a local breakdown of their intended protective effect, as a consequence whereof single, particularly deep pits are formed at the respective spots.

In general, the known complex-forming additives accelerate the dissolution of the aluminum due to their "trapping " of released $Al^{3+}$ ions and thus cause an increased roughening action. As a result thereof, quite often no creation of new pores is initiated, but pores which are already existent continue to grow. i.e., increased pitting occurs. It is true that usually the growth of individual pores is stopped relatively soon by the known inhibiting additives, and the formation of new pores can be initiated. These inhibitors exhibit, however, the decisive disadvantage that this protective effect can collapse due to voids, alloy constituents, and the like, so that single pores which are too deep are obtained on an otherwise evenly and uniformly roughened surface. Support materials exhibiting this kind of defects are not suitable for lithographic purposes.

There have also been disclosed aqueous electrolyte solutions having a content of inorganic or organic fluorine compounds, which may be present alone or in combination with other components, or of hydrofluoric acid, respectively, for the roughening of aluminum. Examples of such disclosures are:

German Pat. No. 120,061, describing the use of alkali metal salts of hydrofluoric acid in the production of Al or Zn printing plate supports;

German Pat. No. 695,182, describing the use of hydrofluoric acid or its salts in the production of bearing surfaces of pistons or cylinders of aluminum;

German Offenlegungsschrift No. 14 96 825, describing the use of salts of fluoboric acid ($HBF_4$) in an almost saturated solution for the anodic treatment of metallic workpieces; however, only the treatment of steel sheet is explicitly mentioned in this context. In a comparative example, NaF is employed;

German Offenlegungsschrift No. 16 21 090 (British Patent Specification No. 1,166,901), describing the use of fluosilicic acid ($H_2SiF_6$) in a mixture with water and ethylene goycol for etching special Be/Cu or Ni/Fe/P alloys;

German Offenlegungsschrift No. 16 21 115 (U.S. Pat. No. 3,632,486 and No. 3,766,043), describing the use of aqueous hydrofluoric acid in the roughening of aluminum webs for decorative panellings or printing plates, whereby the aluminum is switched such that it forms the anode;

German Auslegeschrift No. 24 33 491 (British Patent Specification No. 1,427,909), describing the use of fluorinated anion-active surfactants (for example, 2-perfluorohexyl-ethane-1-sulfonic acid) in addition to an acid, such as hydrocholoric acid, for producing a "lizard-skin-type" texture on the aluminum surface, under the action of alternating current, whereby the texture which can be achieved in this way is said to give the aluminum surface an attractive appearance; and Japanese patent application No. 17 580/80, describing the use of a mixture of hydrochloric acid and alkali metal halides in the production of aluminum printing plate supports, whereby the only halide used in the examples is NaCl.

Neither the electrolytes mentioned in the above references, nor the other mixed electrolytes, based on aqueous HCl solutions, which have been disclosed so far, result in surfaces of a quality which, irrespective of the peak-to-valley heights to be achieved in each case, is expected from currently available printing plate support materials. The roughening structure of aluminum supports roughened in pure aqueous hydrofluoric acid is too heterogeneous, and similar results are observed in those cases where simple halides (chlorides, fluorides, and the like) are employed as admixtures with a hydrochloric acid electrolyte. So far, complex fluorine compounds have not been used for the roughening of aluminum; a lizard skin-type surface structure is not suited for lithographic purposes.

SUMMARY OF THE INVENTION

It is therefore the object of the present invention to provide any improved process for the electrochemical roughening of aluminum useful for printing plate supports. It is a particular object to provide such a process which makes it possible to achieve a uniformly roughened surface topography, with a broad scale of variations in the mean range of peak-to-valley height values and long bath dwell times.

In accomplishing the foregoing objects, there has been provided according to the present invention a process for the electrochemical roughening of a plate of aluminum or an alloy thereof which is useful for a printing plate support, comprising the steps of immersing the plate in an aqueous mixed electrolyte solution containing HCl and at least one further ionic halogen compound comprising an inorganic fluorine compound which is present in the form of an acid or an alkali metal salt, and the anion of which contains fluorine and at least one further element; and applying an alternating current to the plate. Preferably, the mixed electrolyte contains from about 0.5 to 10% by weight of HCl and from about 0.05 to 5% by weight of the fluorine compound.

Further objects, features and advantages of the present invention will become apparent from the detailed description of preferred embodiments which follows.

DETAILED DESCRIPTION OF PREFERRED EMBODIMENTS

The invention provides a process for the electrochemical roughening of aluminum or of alloys thereof which are useful as printing plate supports, in an aqueous mixed electrolyte solution which contains HCl and at least one further ionic halogen compound, under the action of alternating current. The process of the invention is characterized in that the ionic halogen compound is an inorganic fluorine compound, which is present in the form of an acid or an alkali metal salt and the anion of which contains fluorine and at least one further element. In a preferred embodiment, the aqueous electrolyte solution contains from about 0.5 to 10% by weight, in particular from about 0.8 to 5.0% by weight, of HCl and from about 0.05 to 5% by weight, in particular from about 0.1 to 2.0% by weight, of the fluorine compound.

The inorganic ionic fluorine compound in particular is a complex compound or a compound comparable to this kind of compound. Preferred examples of this type of fluorine compounds are acids or alkali metal salts (including the ammonium salts) with the anions: $SiF_6^{2-}$, $TiF_6^{2-}$, $ZrF_6^{2-}$, $BF_4^-$, $PF_6^-$ and $PO_3F2^-$; compounds with the anions $NbF_6^-$, $TaF_6^-$, $Fe_6^{3-}$, $SbF_6^-$, $HfF_6^{2-}$ and $SO_3F^-$can also be used. Preferably, only one of these compounds is employed, but it is also possible to employ a mixture of several of them.

Suitable base materials for the material to be roughened in accordance with this invention include aluminum or one of its alloys which, for example, can have an Al content of more than 98.5% by weight and additionally can contain small amounts of Si, Fe, Ti, Cu and Zn. Prior to the electrochemical treatment step, these aluminum support materials can be roughened (optionally after a precleaning step) by mechanical means (for example, by brushing and/or by treatment with an abrasive agent). All process steps can be carried out discontinuously using plates or foils, but preferably they are performed continuously using webs.

In particular in continuous processes, the process parameters are normally within the following ranges:

temperature of the electrolyte from about 20° C. to 60° C., current density from about 3 to 200 A/dm$^2$, dwell time of a material spot to be roughened in the electrolyte from about 3 to 100 seconds, and rate of flow of the electrolyte on the surface of the material to be roughened from about 5 to 100 cm/s. In discontinuous processes, the required current densities are rather in the lower region and the dwell times rather in the upper region of the ranges indicated in each case; a flow of the electrolyte can even be dispensed with in these processes. The type of current used usually is normal alternating current having a frequency of from about 50 to 60 Hz, but it is also possible to use modified current types, such as alternating current having different current intensity amplitudes for the anodic and for the cathodic current, lower frequencies, interruptions of current or superposition of two currents of different frequencies and wave shapes. The average peak-to-valley height $R_z$ of the roughened surface is in a range from about 1 to 15 $\mu$m, in particular from about 1.5 to 8.0 $\mu$m. In addition to the above-mentioned components, the aqueous electrolyte may contain aluminum ions in the form of aluminum salts, in particular from about 0.5 to 5.0% by weight of $AlCl_3$.

Precleaning includes, for example, treatment with an aqueous NaOH solution with or without a degreasing agent and/or complex formers, trichloroethylene, acetone, methanol or other commercially available substances known as aluminum treatment agents. Following roughening or, in the case of several roughening steps, between the individual steps, it is possible to perform an additional abrasive treatment, during which in particular a maximum amount of about 2 g/m$^2$ is abraded (between the individual steps, up to about 5 g/m$^2$). Abrasive solutions in general are aqueous alkali metal hydroxide solutions or aqueous solutions of salts showing alkaline rections or aqueous solutions of acids based on $HNO_3$, $H_2SO_4$ or $H_3PO_4$, respectively. Apart from an abrasive treatment step performed between the roughening step and a subsequent anodizing step, there are also known non-electrochemical treatments which substantially have a purely rinsing and/or cleaning effect and are, for example, employed to remove deposits which have formed during roughening ("smut"), or simply to remove electrolyte remainders; dilute aqueous alkali metal hydroxide solutions or water can, for example, be used for these treatments.

The electrochemical roughening process according to the invention is preferably followed by an anodic oxidation of the aluminum in a further process step, in order to improve, for example, the abrasion and adhesion properties of the surface of the support material. Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. Particular preference is thereby given to $H_2SO_4$ and $H_3PO_4$, which may be used alone or in a mixture and/or in a multi-stage anodizing process.

The step of performing an anodic oxidation of the aluminum support material for printing plates is optionally followed by one or more post-treating steps. Post-treating is particularly understood to be a hydrophilizing chemical or electrochemical treatment of the aluminum oxide layer, for example, an immersion treatment of the material in an aqueous solution of polyvinyl phosphonic acid according to German Pat. No. 16 21 478 (British Patent Specification No. 1,230,447), an immersion treatment in an aqueous solution of an alkali-metal silicate according to German Auslegeschrift No. 14 71 707 (U.S. Pat. No. 3,181,461), or an electrochemical treatment (anodic oxidation) in an aqueous solution of an alkali metal silicate according to German Offenlegungsschrift No. 25 32 769 (U.S. Pat. No. 3,902,976). These post-treatment steps serve, in particular, to improve even further the hydrophilic properties of the aluminum oxide layer, which are already sufficient for many fields of application, with the other well-known properties of the layer being at least maintained.

The materials prepared in accordance with this invention are used as supports for offset printing plates, i.e., one or both surfaces of the support material are coated with a photosensitive composition, either by the maufacturers of presensitized printing plates or directly by the users. Radiation- (photo-) sensitive layers basically include all layers which after irradiation (exposure), optionally followed by developing and/or fixing, yield a surface in imagewise configuration which can be used for printing.

Apart from the silver halide-containing layers used for many applications, various other layers are known which are, for example, described in "Light-Sensitive Systems" by Jaromir Kosar, published by John Wiley & Sons, New York, 1965: colloid layers containing chromates and dichromates (Kosar, Chapter 2); layers containing unsaturated compounds, in which upon exposure, these compounds are isomerized, rearranged, cyclized, or crosslinked (Kosar, Chapter 4); layers containing compounds which can be photopolymerized, in which, on being exposed, monomers or prepolymers undergo polymerization, optionally with the aid of an initiator (Kosar, Chapter 5); and layers containing o-diazoquionones, such as naphthoquinone-diazides, p-diazoquinones, or condensation products of diazonium salts (Kosar, Chapter 7).

The layers which are suitable also include the electrophotographic layers, i.e., layers which contain an inorganic or organic photoconductor. In addition to the photosensitive substances, these layers can, of course, also contain other constituents, such as for example, resins, dyes or plasticizers. In particular, the following photosensitive compositions or compounds can be employed in the coating of the support materials prepared in accordance with this invention.

positive-working reproduction layers which contain o-quinone diazides, preferably o-naphthoquinone diazides, such as high or low molecularweight naphthoquinone-(1,2)-diazide-(2)-sulfonic acid esters or amides as the light-sensitive compounds, which are described, for example, in German Pat. No. 854,890; No. 865,109; No. 879,203; No. 894,959; No. 938,233; No. 1,109,521; No. 1,144,705; No. 1,118,606; No. 1,120,273; No. 1,124,817 and No. 2,331,377 and in European patent applications No. 0,021,428 and No. 0,055,814;

negative-working reproduction layers which contain condensation products from aromatic diazonium salts and compounds with active carbonyl groups, preferably condensation products formed from diphenylaminediazonium salts and formaldehyde, which are described, for example, in German Pat. No. 596,731; No. 1,138,399; No. 1,138,400; No. 1,138,401; No. 1,142,871 and No. 1,154,123; U.S. Pat. No. 2,679,498 and No. 3,050,502 and British Patent Specification No. 712,606;

negative-working reproduction layers which contain co-condensation products of aromatic diazonium compounds, sucn as are, for example, described in German Pat. No. 20 65 732, which comprise products possessing at least one unit each of (a) an aromatic diazonium salt compound which is able to participate in a condensation reaction and (b) a compound which is able to participate in a condensation reaction, such as a phenol ether or an aromatic thioether, which are connected by a bivalent linking member derived from a carbonyl compound which is capable of participating in a condensation reaction, such as a methylene group;

positive-working layers according to German Offenlegungsschrift No. 26 10 842, German Pat. No. 27 18 254 or German Offenlegungsschrift No. 29 28 636, which contain a compound which, on being irradiated, splits off an acid, a monomeric or polymeric compound which possesses at least one C—O—C group which can be split off by acid (e.g., an orthocarboxylic acid ester group or a carboxylic acid amide acetal group), and, if appropriate, a binder;

negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. No. 2,760,863 and No. 3,060,023, and in German Offenlegungsschriften No. 20 64 079 and No. 23 61 041;

negative-working layers according to German Offenlegungsschrift No. 30 36 077, which contain, as the photo-sensitive compound, a diazonium salt polycondensation product or an organic azido compound, and, as the binder, a high-molecular weight polymer with alkenylsulfonylurethane or cycloalkenylsulfonylurethane side groups.

It is also possible to apply photo-semiconducting layers to the support materials prepared in accordance with this invention, such as described, for example, in German Pat. No. 1,117,391, No. 1,522,497, No. 1,572,312, No. 2,322,046 and No. 2,322,047, as a result of which highly photosensitive electrophotographic printing plates are obtained.

From the coated offset printing plates prepared from the support materials produced in accordance with the present invention, the desired printing forms are obtained in known manner by imagewise exposure or irradiation, followed by washing out the non-image areas by means of a developer, for example, an aqueous-alkaline developer solution.

The process according to this invention combines, inter alia, the following advantages:

- The products have a uniform surface topography, a property, by which both the stability of print runs which can be achieved using printing forms produced from this support material, and also the water acceptance during printing, are positively influenced.
- Compared with the use of electrolytes containing purely hydrochloric acid, "pitting" (pronounced depressions, compared to the roughening of the surrounding surface) occurs less frequently and can even be suppressed completely.
- These surface properties can be materialized without much equipment expenditure, and the properties can be achieved within a wide range of roughening intensities.
- Employing this process, surfaces roughened in a particularly slight and uniform manner can be achieved, which is not possible to the same degree using the known electrolytes.
- The mixed electrolyte used in the process of this invention is electrochemically stable, i.e., it does not decompose when high current loads (voltages) are applied.

In the above description and in the Examples which follow, percentages denote percent by weight, unless otherwise stated. Parts by weight (p.b.w.) are related to parts by volume (p.b.v.) as the g is related to the $cm^3$.

EXAMPLES 1 TO 30 AND COMPARATIVE EXAMPLES C1 TO C12

An aluminum sheet is first treated with an aqueous solution containing 20 g/l of NaOH, at room temperature, for a time of 60 seconds and is then freed from any alkaline residues which may be left, by briefly dipping it into a solution of a composition corresponding to that of the roughening electrolyte. Roughening is performed in the electrolyte systems and under the conditions described in the Tables below. Roughening is followed by an anodic oxidation in an aqueous electrolyte with a content of $H_2SO_4$ and $Al^{3+}$ ions, until a layer weight of 3 $g/m^2$ is reached.

Classifying into quality grades (surface topography) is made by visual assessment under a microscope, a homogeneously roughened surface which is free from pitting being assigned quality grade "1" (best grade). A surface with severe pitting of a size exceeding 100 $\mu m$ or with an extremely nonuniformly roughened or almost bright-rolled surface is assigned quality grade "10" (worst grade). Surfaces of qualities between these two extreme values are assigned quality grades "2" to "9".

All Examples and Comparative Examples are performed using symmetric alternating current of a frequency of 50 Hz, one electrode being constituted by the aluminum sheet and the other electrode being constituted by a graphite plate.

TABLE

| Example No. | Concentration and Composition of the aqueous electrolyte: Quantity of HCl (%) | Admixture | Quantity of admixture (%) | Current density (A/dm²) | Roughening time (sec) | Peak-to-valley height $R_z$ (μm) | Quality grade |
|---|---|---|---|---|---|---|---|
| C 1 | 1,2 | — | — | 40 | 15 | 4,29 | 4 |
| C 2 | 1,2 | — | — | 60 | 10 | 4,03 | 4 |
| C 3 | 1,2 | — | — | 80 | 8 | 4,97 | 5 |
| C 4 | 1,2 | — | — | 100 | 6 | 5,45 | 4 |
| C 5 | 1,2 | — | — | 40 | 20 | 5,14 | 4 |
| C 6 | 1,2 | — | — | 80 | 10 | 5,91 | 4 |
| C 7 | 1,2 | — | — | 100 | 8 | 6,76 | 5 |
| C 8 | 1,2 | — | — | 120 | 6 | 8,49 | 6 |
| C 9 | 1,2 | — | — | 40 | 25 | 6,21 | 4 |
| C 10 | 1,2 | — | — | 80 | 12 | 7,88 | 6 |
| C 11 | 1,2 | — | — | 120 | 8 | 8,03 | 7 |
| C 12 | 1,2 | — | — | 40 | 38 | 8,13 | 6 |
| 1 | 1,2 | $Na_2PO_3F$ | 0,1 | 60 | 10 | 3,86 | 2 |
| 2 | 1,2 | $Na_2PO_3F$ | 0,2 | 60 | 10 | 3,38 | 1 |
| 3 | 1,2 | $Na_2PO_3F$ | 0,1 | 80 | 8 | 4,37 | 2 |
| 4 | 1,2 | $Na_2PO_3F$ | 0,2 | 80 | 8 | 3,78 | 1 |
| 5 | 1,2 | $Na_2PO_3F$ | 0,1 | 100 | 6 | 4,62 | 2 |
| 6 | 1,2 | $Na_2PO_3F$ | 0,2 | 100 | 6 | 3,72 | 1 |
| 7 | 1,2 | $Na_2PO_3F$ | 0,2 | 100 | 12 | 5,64 | 2 |
| 8 | 1,2 | $H_2SiF_6$ | 0,1 | 40 | 15 | 2,35 | 1 |
| 9 | 1,2 | $H_2SiF_6$ | 0,1 | 60 | 10 | 2,10 | 1 |
| 10 | 1,2 | $H_2SiF_6$ | 0,1 | 80 | 8 | 3,18 | 1 |
| 11 | 1,2 | $H_2SiF_6$ | 0,1 | 100 | 6 | 3,47 | 1 |
| 12 | 1,2 | $H_2SiF_6$ | 0,1 | 40 | 20 | 3,30 | 1 |
| 13 | 1,2 | $H_2SiF_6$ | 0,1 | 40 | 25 | 4,24 | 1 |
| 14 | 1,2 | $H_2SiF_6$ | 0,3 | 80 | 10 | 1,88 | 1 |
| 15 | 1,2 | $H_2SiF_6$ | 0,3 | 100 | 8 | 2,03 | 1 |
| 16 | 1,2 | $H_2SiF_6$ | 0,3 | 120 | 6 | 3,38 | 2 |
| 17 | 1,2 | $H_2SiF_6$ | 0,3 | 40 | 25 | 2,15 | 1 |
| 18 | 1,2 | $H_2SiF_6$ | 0,3 | 80 | 12 | 2,46 | 2 |
| 19 | 1,2 | $H_2SiF_6$ | 0,3 | 120 | 8 | 5,51 | 3 |
| 20 | 1,2 | $H_2SiF_6$ | 0,3 | 40 | 38 | 2,71 | 1 |
| 21 | 1,2 | $K_2TiF_6$ | 0,1 | 100 | 6 | 4,73 | 2 |
| 22 | 1,2 | $K_2TiF_6$ | 0,5 | 100 | 6 | 2,74 | 1 |
| 23 | 1,2 | $K_2TiF_6$ | 0,5 | 80 | 10 | 2,12 | 1 |
| 24 | 1,2 | $K_2ZrF_6$ | 0,5 | 100 | 10 | 2,04 | 1 |
| 25 | 1,2 | $K_2ZrF_6$ | 0,5 | 120 | 8 | 4,98 | 2 |
| 26 | 1,2 | $HBF_4$ | 0,2 | 60 | 15 | 5,68 | 3 |
| 27 | 1,2 | $HBF_4$ | 0,5 | 60 | 15 | 4,29 | 2 |
| 28 | 1,2 | $HBF_4$ | 1,0 | 60 | 15 | 3,43 | 1 |
| 29 | 1,2 | $HPF_6$ | 0,5 | 40 | 25 | 4,18 | 1 |
| 30 | 1,2 | $HPF_6$ | 0,5 | 100 | 8 | 2,57 | 1 |

EXAMPLE 31

An aluminum sheet prepared in accordance with Example 21 is immersed into an aqueous solution containing 5 g/l of polyvinylphosphonic acid, at a temperature of 40° C. and for a duration of 30 seconds; then it is rinsed with fully deionized water and dried. For obtaining a lithographic printing plate, the sheet is coated with the following negative-working photosensitive solution:

0.70 p.b.w. of the polycondensation product of 1 mole of 3-methoxy-diphenylamine-4-diazonium sulfate and 1 mole of 4,4'-bis-methoxymethyl-diphenyl ether, precipitated as the mesitylene sulfonate, 3.40 p.b.w. of 85% strength aqueous $H_3PO_4$, 3.00 p.b.w. of a modified epoxide resin, obtained by reacting 50 parts by weight of an epoxide resin having a molecular weight of less than 1,000 and 12.8 parts by weight of benzoic acid in ethylene glycol monomethyl ether, in the presence of benzyltrimethyl-ammonium hydroxide, 0.44 p.b.w. of finely-ground Heliogen Blue G (C.I. 74,100), 62.00 p.b.v. of ethylene glycol monomethyl ether, 30.60 p.b.v. of tetrahydrofuran, and 8.00 p.b.v. of butyl acetate.

The printing plate is imagewise exposed and rapidly developed, without scum, with an aqueous solution containing $Na_2SO_4$, $MgSO_4$, $H_3PO_4$, a non-ionic surfactant, benzyl alcohol and n-propanol. When the printing form is used for printing, a very good inkwater balance and an excellent layer adhesion are stated. The number of prints which can be made is about 200,000.

EXAMPLE 32

An aluminum foil, which has been prepared in accordance with Example 16 and post-treated in accordance with Example 31, is coated with the following positive-working photosensitive solution:

6.60 p.b.w. of a cresol/formaldehyde novolak (softening range 105° to 120° C., according to DIN 53,181), 1.10 p.b.w. of the 4-(2-phenyl-prop-2-yl)phenyl ester of naphthoquinone-(1,2)-diazide-(2)-sulfonic acid-(4), 0.60 p.b.w. of 2,2'-bis-naphthoquinone-(1,2)-diazide-(2)-sulfonyloxy-(5)-dinapthyl-(1,1')-methane,
0.24 p.b.w. of naphthoquinone-(1,2)-diazide-(2)-sulfochloride-(4),
0.08 p.b.w. of crystal violet, and
91.36 p.b.w. of a mixture of 4 p.b.v. of ethylene glycol monomethyl ether, 5 p.b.v. of tetrahydrofuran and 1 p.b.v. of acetic acid butyl ester.

By imagewise exposure and developing in an aqueous solution containing $Na_2SiO_3$, $Na_3PO_4$ and $NaH_2PO_4$, a printing form is produced from this plate, which gives 150,000 prints.

EXAMPLE 33

A support material prepared in accordance with Example 4 is coated with a solution of the following composition in order to obtain an electrophotographic offset printing plate:

10.00 p.b.w. of 2-vinyl-5-(4'-diethylaminophenyl)-4-(2'-chlorophenyl)-oxazole,
10.00 p.b.w. of a copolymer of styrene and maleic acid anhydride, having a softening point of 210° C.,
0.02 p.b.w. of Rhodamine FB, and
300.00 p.b.w. of ethylene glycol monomethyl ether.

By means of a corona, the layer is negatively charged to about 400 V in the dark. The charged plate is imagewise exposed in a reprographic camera and then developed with an electrophotographic suspension-type developer obtained by dispersing 3.0 p.b.w. of magnesium sulfate in a solution of 7.5 p.b.w. of pentaerythritol resin ester in 1,200 p.b.v. of an isoparraffin mixture having a boiling range of 185° to 210° C. After removal of excess developer liquid, the developer is fixed and the plate is immersed, during 60 seconds, in a solution comprised of 35 p.b.w. of sodium metasilicate $\times 9H_2O$, 140 p.b.w. of glycerol, 550 p.b.w. of ethylene glycol and 140 p.b.w. of ethanol. Then, the plate is rinsed with a vigorous jet of water, whereby those areas of the photoconductor layer, which are not covered by toner, are removed. After rinsing, the printing form is ready for printing.

What is claimed is:

1. A process for the electrochemical roughening of a plate of aluminum or an alloy thereof which is useful for a printing plate support, comprising the steps of (A) immersing the plate in an aqueous mixed electrolyte solution containing (i) from about 0.5 to 10% by weight of HCl and (ii) at least one further inorganic electrolyte comprising an inorganic fluorine compound which is present in the form of an acid or an alkali metal salt and which contains an anion comprised of fluorine and at least one further element, such that said mixed electrolyte solution contains from about 0.05 to 5% by weight of said fluorine compound; and (B) applying an alternating current to the plate to produce a uniformly roughened plate for use as an offset printing plate support.

2. A process as claimed in claim 1, wherein the mixed electrolyte contains from about 0.8 to 5.0% by weight of HCl and from about 0.1 to 2.0% by weight of the fluorine compound.

3. A process as claimed in claim 1, wherein the fluorine compound comprises a complex compound.

4. A process as claimed in claim 1, wherein the fluorine compound contains an anion selected from the group including $SiF_6^{2-}$, $TiF_6^{2-}$, $ZrF_6^{2-}$, $BF_4^-$, $PF_6^-$ and $PO_3F^{2-}$.

* * * * *